US009174103B2

(12) United States Patent
Curtis et al.

(10) Patent No.: US 9,174,103 B2
(45) Date of Patent: Nov. 3, 2015

(54) GOLF CLUB HEAD OPTIMIZED FOR SOUND

(71) Applicant: Acushnet Company, Fairhaven, MA (US)

(72) Inventors: Andrew J. Curtis, Carlsbad, CA (US); Noah de la Cruz, San Diego, CA (US); John Morin, Poway, CA (US); Stephanie Bezilla, Carlsbad, CA (US); Thomas Orrin Bennett, Carlsbad, CA (US); Stephen S. Murphy, Carlsbad, CA (US)

(73) Assignee: ACUSHNET COMPANY, Fairhaven, MA (US)

( * ) Notice: Subject to any disclaimer, the term of this patent is extended or adjusted under 35 U.S.C. 154(b) by 0 days.

(21) Appl. No.: 13/826,052

(22) Filed: Mar. 14, 2013

(65) Prior Publication Data

US 2014/0274453 A1 Sep. 18, 2014

(51) Int. Cl.

| | |
|---|---|
| ***A63B 53/04*** | (2015.01) |
| ***A63B 53/08*** | (2015.01) |
| *A63B 59/00* | (2015.01) |
| *A63B 71/06* | (2006.01) |

(52) U.S. Cl.

CPC ..... *A63B 53/08* (2013.01); *A63B 53/0466* (2013.01); *A63B 59/0092* (2013.01); *A63B 2053/045* (2013.01); *A63B 2053/0433* (2013.01); *A63B 2071/0625* (2013.01)

(58) Field of Classification Search

CPC ..... A63B 53/0466; A63B 53/08; A63B 2053/045; A63B 2053/0433; A63B 2059/0003; A63B 59/0092; A63B 2071/0625

USPC ..... 473/324–350, 287–292

See application file for complete search history.

(56) References Cited

U.S. PATENT DOCUMENTS

| | | | | |
|---|---|---|---|---|
| 5,080,366 | A * | 1/1992 | Okumoto et al. | 473/348 |
| 5,292,129 | A * | 3/1994 | Long et al. | 473/346 |
| 5,873,791 | A * | 2/1999 | Allen | 473/309 |
| 5,908,356 | A * | 6/1999 | Nagamoto | 473/224 |
| 5,941,782 | A * | 8/1999 | Cook | 473/346 |
| 6,056,649 | A * | 5/2000 | Imai | 473/328 |
| 6,533,679 | B1 * | 3/2003 | McCabe et al. | 473/335 |
| 6,595,871 | B2 * | 7/2003 | Sano | 473/342 |
| 6,852,038 | B2 * | 2/2005 | Yabu | 473/224 |
| 6,945,877 | B2 * | 9/2005 | Kobayashi et al. | 473/345 |
| 7,041,189 | B2 * | 5/2006 | Caldwell et al. | 156/242 |
| 7,241,230 | B2 * | 7/2007 | Tsunoda | 473/324 |
| 7,273,423 | B2 * | 9/2007 | Imamoto | 473/332 |
| 7,390,271 | B2 * | 6/2008 | Yamamoto | 473/345 |

(Continued)

*Primary Examiner* — Sebastiano Passaniti

(74) *Attorney, Agent, or Firm* — Adler Pollock & Sheehan P.C.; Daniel J. Holmander, Esq.; George N. Chaclas, Esq.

(57) ABSTRACT

A golf club head optimized for sound has a body that defines an interior cavity. The body includes at least one of a sole portion, skirt portion, or a crown portion. At least the sole portion is stiffened to provide a higher frequency sound. The stiffened sole portion increases the frequency range of the golf club head by at least 300 Hz with an overall frequency of greater than about 3000 Hz. The stiffened sole portion provides a higher frequency sound with a minimal increase in the overall weight of the golf club head. In one embodiment, the stiffened sole portion increases the weight of the golf club head by less than 10 grams with the overall weight of the golf club head less than 220 grams. In operation, the golf club head with at least the stiffened sole portion impacts the golf ball to provide an aesthetically pleasing sound.

8 Claims, 17 Drawing Sheets

(56) References Cited

U.S. PATENT DOCUMENTS

| | | | | |
|---|---|---|---|---|
| 7,419,441 | B2 * | 9/2008 | Hoffman et al. | 473/334 |
| 7,500,924 | B2 * | 3/2009 | Yokota | 473/332 |
| 7,572,193 | B2 * | 8/2009 | Yokota | 473/328 |
| 7,641,568 | B2 | 1/2010 | Hoffman et al. | |
| 7,651,410 | B2 * | 1/2010 | Shimazaki | 473/335 |
| 7,758,453 | B2 * | 7/2010 | Horacek et al. | 473/345 |
| 7,775,904 | B2 * | 8/2010 | Hirano | 473/332 |
| 7,803,067 | B2 * | 9/2010 | Horacek et al. | 473/345 |
| 7,828,676 | B2 * | 11/2010 | Wada et al. | 473/346 |
| 7,883,431 | B2 * | 2/2011 | Matsunaga et al. | 473/329 |
| 7,887,433 | B2 | 2/2011 | Hoffman et al. | |
| 8,029,385 | B2 * | 10/2011 | Horacek et al. | 473/345 |
| 8,033,932 | B2 * | 10/2011 | Wada et al. | 473/346 |
| 8,172,700 | B2 | 5/2012 | Hoffman et al. | |
| 8,192,300 | B2 | 6/2012 | Wada et al. | |
| 8,206,242 | B2 | 6/2012 | Jertson et al. | |
| 8,226,500 | B2 * | 7/2012 | Yamamoto et al. | 473/346 |
| 8,323,121 | B2 * | 12/2012 | Wada et al. | 473/346 |
| 8,328,658 | B2 * | 12/2012 | Bennett et al. | 473/328 |
| 8,641,555 | B2 * | 2/2014 | Stites et al. | 473/328 |
| 8,657,703 | B2 * | 2/2014 | Wada et al. | 473/335 |
| 8,721,471 | B2 * | 5/2014 | Albertsen et al. | 473/328 |
| 8,727,910 | B2 * | 5/2014 | Nakano | 473/346 |
| 2002/0065147 | A1 * | 5/2002 | Sano | 473/346 |
| 2003/0114244 | A1 * | 6/2003 | Matsunaga | 473/345 |
| 2008/0132355 | A1 | 6/2008 | Hoffman et al. | |
| 2008/0220894 | A1 * | 9/2008 | Matsunaga et al. | 473/346 |
| 2010/0048324 | A1 * | 2/2010 | Wada et al. | 473/346 |
| 2010/0261547 | A1 * | 10/2010 | Brekke et al. | 473/346 |
| 2010/0261549 | A1 * | 10/2010 | Wada et al. | 473/346 |
| 2011/0312440 | A1 * | 12/2011 | Wada et al. | 473/346 |

* cited by examiner

GOLF CLUB HEAD OPTIMIZED FOR SOUND

BACKGROUND

The present invention relates generally to golf clubs, and more particularly to a golf club head optimized for sound. More specifically, the golf club head has at least a sole portion which is sufficiently stiffened to provide a higher frequency sound which is aesthetically pleasing when the golf club head impacts the golf ball.

The sound of a golf club upon impact may influence an opinion of a golf club. Some of the golf clubs now on the market have sound characteristics that are not pleasing to the user. Modern large drivers or metal wood golf clubs with high moments of inertia typically have a golf club head with a sole defining a large area. Oftentimes, the issue with the sound characteristics can be attributed to the large, flat, thin sole of the golf club head.

When the driver hits the ball, the frequency of the sound that results depends upon the stiffness of the surfaces of the driver head. Large thin flat surfaces, such as the sole on a modern deep driver head, tend to create lower frequencies when excited in this manner. Observation tells us that many golfers prefer heads that produce higher frequencies.

Designers of large modern drivers are always trying to conserve weight in order to be able to optimize the center of gravity location of the golf head, or to add features for user adjustment of the head. A thin, light sole is usually preferable if the sound characteristics that result can be kept acceptable. The designer wants to use weight elsewhere, and generally wants to minimize the thickness of the sole.

The thin large sole can also be made much stiffer by adding curvature. But adding curvature usually results in moving more of the golf club head's weight up and away from the ground. Driver designers are usually trying to get the center of gravity of the head as low as possible. Thus, designers are looking for ways to keep the driver sole relatively flat in order to help keep the center of gravity of the driver as close to the ground as possible.

Therefore, it would be advantageous in golf club driver design to be able to create a sole that is stiff and to minimize the overall weight of the club while not providing the golf club head with a poor sound at impact with the golf ball. Also, it is desired to minimize the weight in the sole in order to have more discretionary design weight for other uses.

BRIEF SUMMARY OF THE INVENTION

The present invention relates generally to golf clubs, and more particularly to a golf club head optimized for sound. More specifically, the golf club head has at least a sole portion which is sufficiently stiffened to provide a higher frequency sound, with minimal increase in the overall weight of the golf club head, which is aesthetically pleasing when the golf club head impacts the golf ball.

A golf club head, such as a metal wood golf club head, is optimized for sound. The golf club head has a body that defines an interior cavity. The body includes a sole portion, a crown portion, a hosel, heel portion, toe portion, rear portion, and a front portion including a striking face. In the present invention, at least the sole portion is sufficiently stiffened to provide a higher frequency sound.

At least one or more internal means, external means, or combination thereof in whole or part, for stiffening the golf club head, and in particular the sole portion, is provided. The internal means for stiffening the sole portion is substantially disposed within the interior cavity. The internal means for stiffening the sole portion engages at least an internal surface of the sole portion to provide a higher frequency sound. For example, the internal means for stiffening may include one or more of the following: one or more thickened regions, one or more rib members, or a box beam structure. The stiffened sole portion of the internal means for stiffening significantly increases the frequency range of the golf club head. In one embodiment, the stiffened sole portion of the internal means for stiffening increases the frequency range of the golf club head by at least 300 Hz to provide an overall frequency of greater than about 3000 Hz. For example, the stiffened sole portion of the internal means for stiffening significantly increases the frequency range of the golf club head between approximately 100 Hz and 300 Hz or more, and more preferably between approximately 200 Hz and 300 Hz or more, and even more preferably greater than 300 Hz.

In one embodiment, the thickened region is welded to an internal surface of the sole portion. The sole portion may include a first thickened region defining a first thickened region thickness and a second thickened region defining a second thickened region thickness. Also, the thickened region may have a range of thickness, in one embodiment, less than or equal to 1 mm. Of course, one more thickened regions may be used having a range of thickened region thickness to provide a higher frequency with a minimal increase in the overall weight of the golf club head. Furthermore, in another embodiment, the range of thickness of the internal means for stiffening the sole portion is greater than the range of thickness of the internal means for stiffening the crown portion.

In another embodiment, an internal surface of a separate sole portion is first stiffened with the one or more ribs and subsequently welded to the golf club head. In a further embodiment, the channel is cast into an internal surface of the sole portion and a plate is welded over the top of the channel to provide a box beam structure. In still another embodiment, a preformed channel having a plate member is welded to an internal surface of the sole portion. In yet another embodiment, the thickened region is formed along an internal surface of the sole portion, through the skirt portion, and into the crown portion. Alternatively, the thickened region is wrapped along an internal surface from the sole portion, through the skirt portion, and into the crown portion.

In another embodiment, at least one or more external means for stiffening the sole portion may be provided. The external means for stiffening the sole portion is substantially disposed on an external surface of the body. The external means for stiffening the sole portion engages at least an external surface of the sole portion to provide a higher frequency sound. For example, the external means for stiffening may include one or more of the following: one or more thickened regions, one or more rib members, or a a box beam structure. The stiffened sole portion of the external means for stiffening significantly increases the frequency range of the golf club head. In one embodiment, the stiffened sole portion of the external means for stiffening increases the frequency range of the golf club head by at least 300 Hz to provide an overall frequency of greater than about 3000 Hz. For example, the stiffened sole portion of the external means for stiffening significantly increases the frequency range of the golf club head between approximately 100 Hz and 300 Hz or more, and more preferably between approximately 200 Hz and 300 Hz or more, and even more preferably greater than 300 Hz.

In one embodiment, the thickened region member is welded to an external surface of the sole portion. The sole portion may include a first thickened region defining a first thickened region thickness and a second thickened region defining a second thickened region thickness. Also, the thickened region may have a range of thickness, in one embodiment, less than or equal to 1 mm. Of course, one more thickened region may be used having a range of region thickness to provide a higher frequency with a minimal increase in the overall weight of the golf club head. Furthermore, in another embodiment, the thickness of the external means for stiffening the sole portion is greater than thickness of the internal means for stiffening the crown portion.

In another embodiment, an external surface of a separate sole portion is first stiffened with the one or more ribs and subsequently welded to the golf club head. In a further embodiment, the channel is cast into an external surface of the sole portion and a plate is welded over the top of the channel to provide a box beam structure. In still another embodiment, a preformed channel having a plate member is welded to an external surface of the sole portion. In yet another embodiment, the thickened region is formed along an external surface of the sole portion, through the skirt portion, and into the crown portion. Alternatively, the thickened region is wrapped along an external surface from the sole portion, through the skirt portion, and into the crown portion.

The internal and external means for stiffening at least the sole portion provides a higher frequency sound with a minimal increase in the overall weight of the golf club head. In one embodiment, the stiffened sole portion increases the weight of the golf club head by less than about 10 grams with the overall weight of the golf club head being less than 220 grams. In operation, the golf club head with at least the stiffened sole portion impacts the golf ball to provide an aesthetically pleasing sound.

The internal means and external means for stiffening of the sole portion may be configured with the golf club head using a variety of methods of manufacture, but not limited to, welding, casting, press-forming, mechanical joining, press-fitting, mechanical fasteners, forming, joining, molding, thermal-diffusion pressing, explosive bonding, forging, brazing, stamping, diffusion, and adhesive bonding or any of various combinations of these methods.

Objectives, features and advantages of the embodiments shall become apparent as the description thereof proceeds when considered in connection with the accompanying illustrative drawings.

BRIEF DESCRIPTION OF THE DRAWING FIGURES

In the drawings which illustrate several exemplary modes or embodiments for carrying out the present invention:

Figure 1:
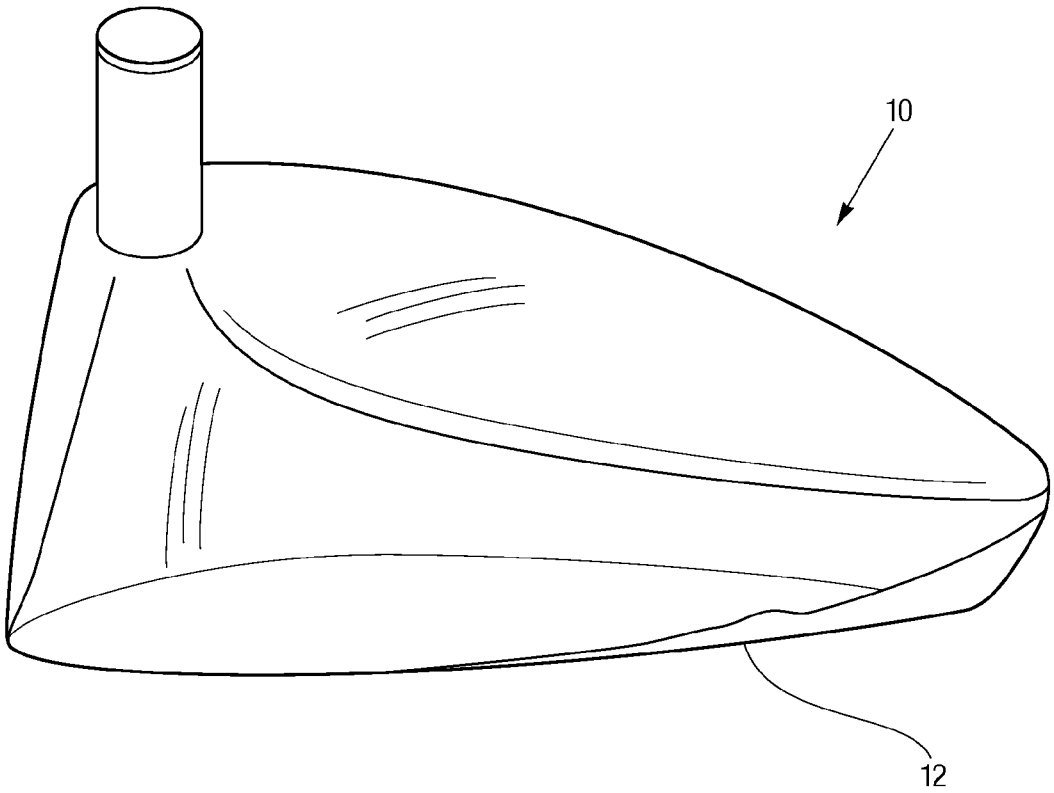
FIG. 1 is a heel side view of an embodiment of the golf club head used for purposes of the simulation images below.
Figure 6:
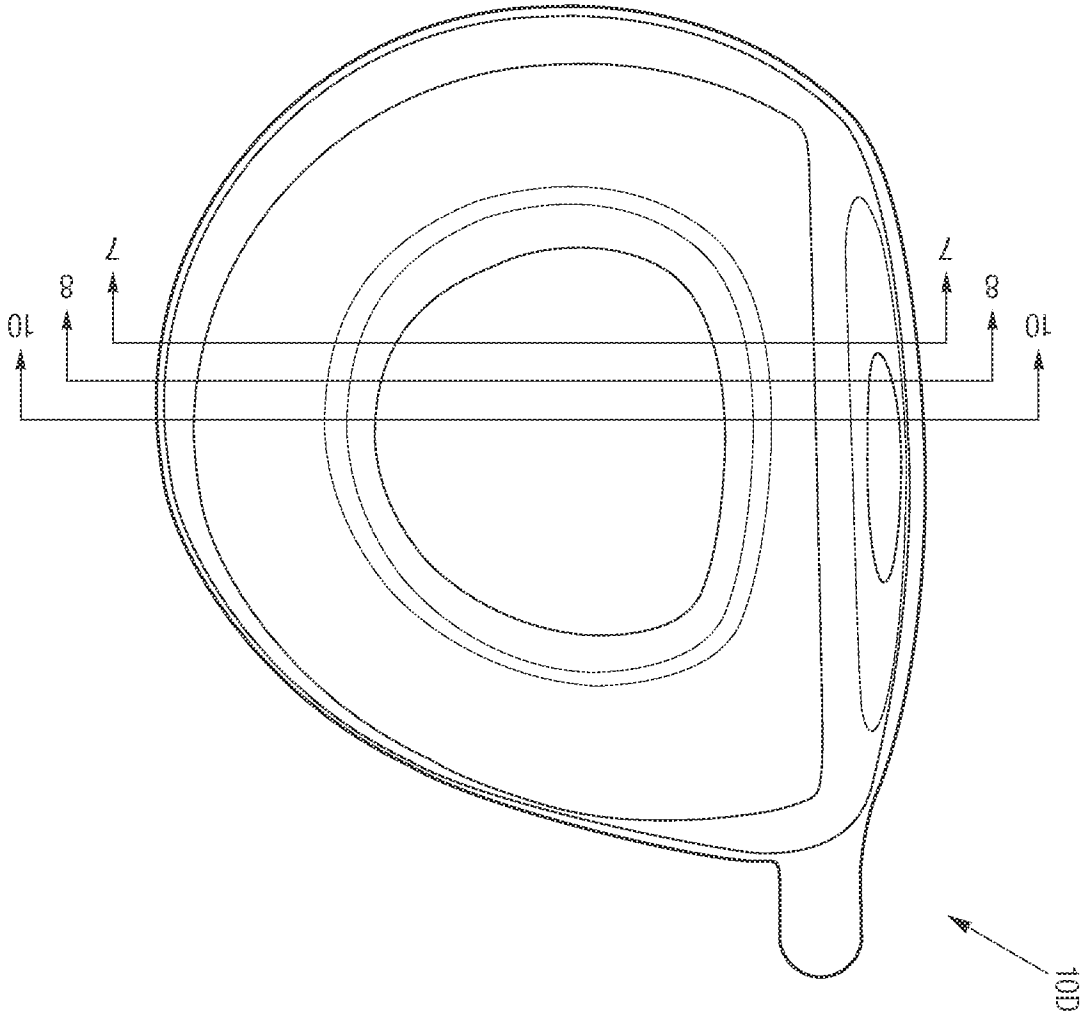
FIG. 6 is a top view of the crown portion of the golf club head of FIG. 5.
Figure 8:
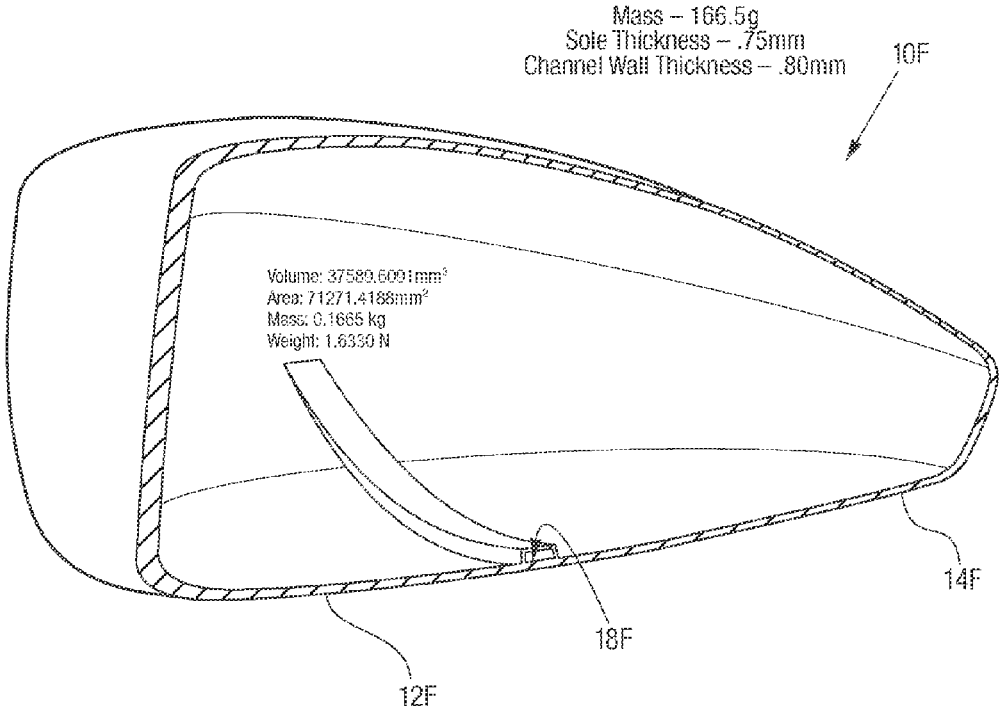
Figure 9:
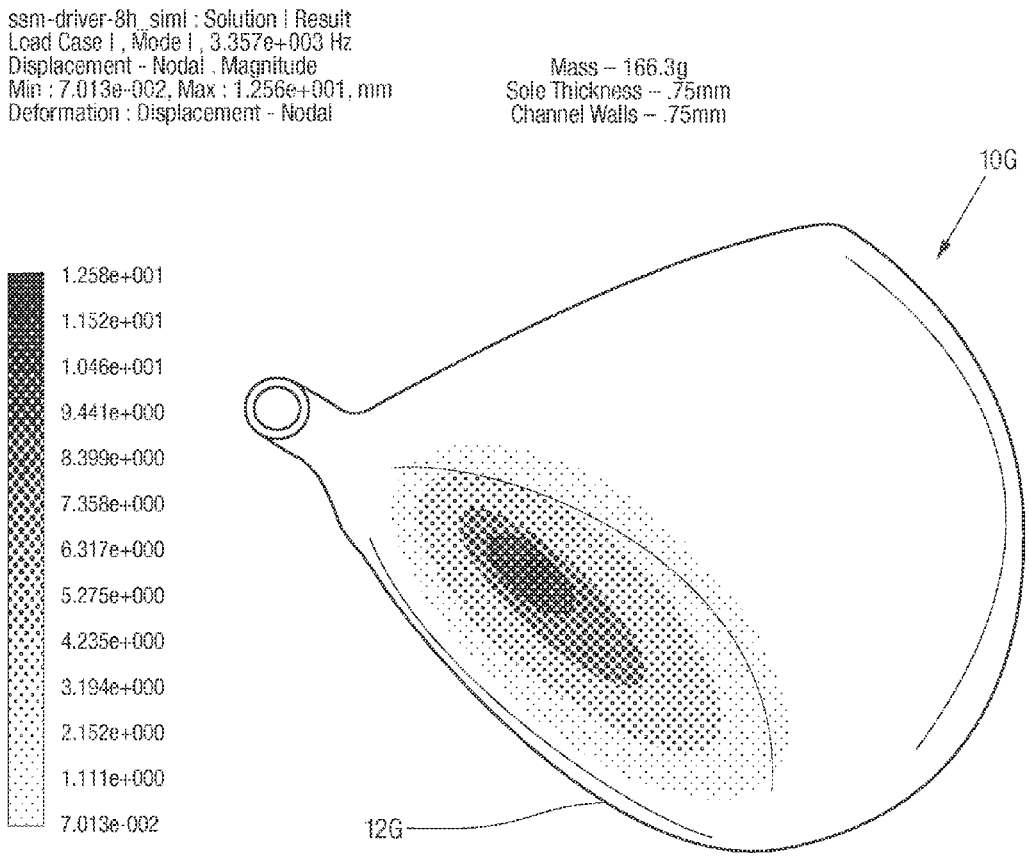
Figure 10:
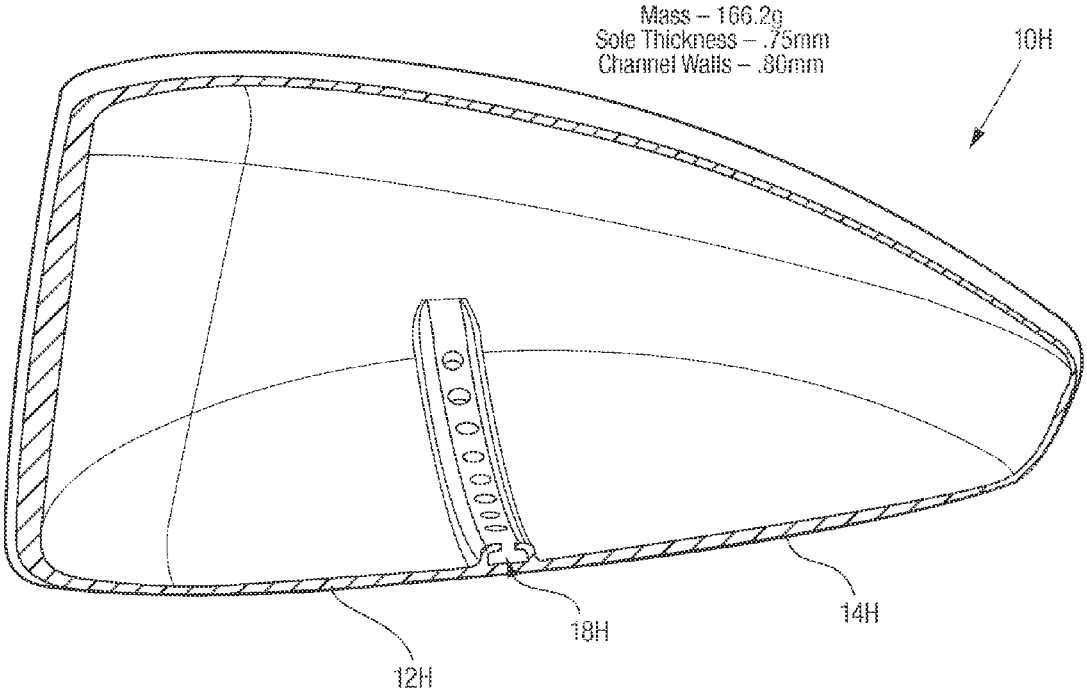
Figure 11:
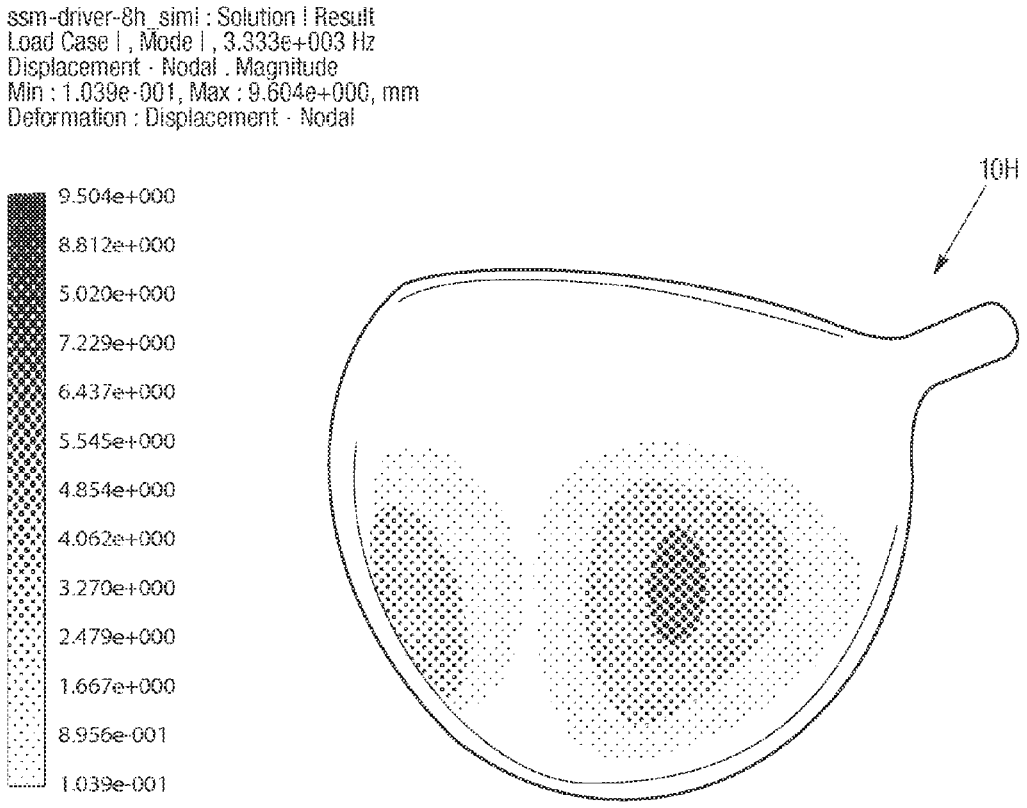
Figure 12:
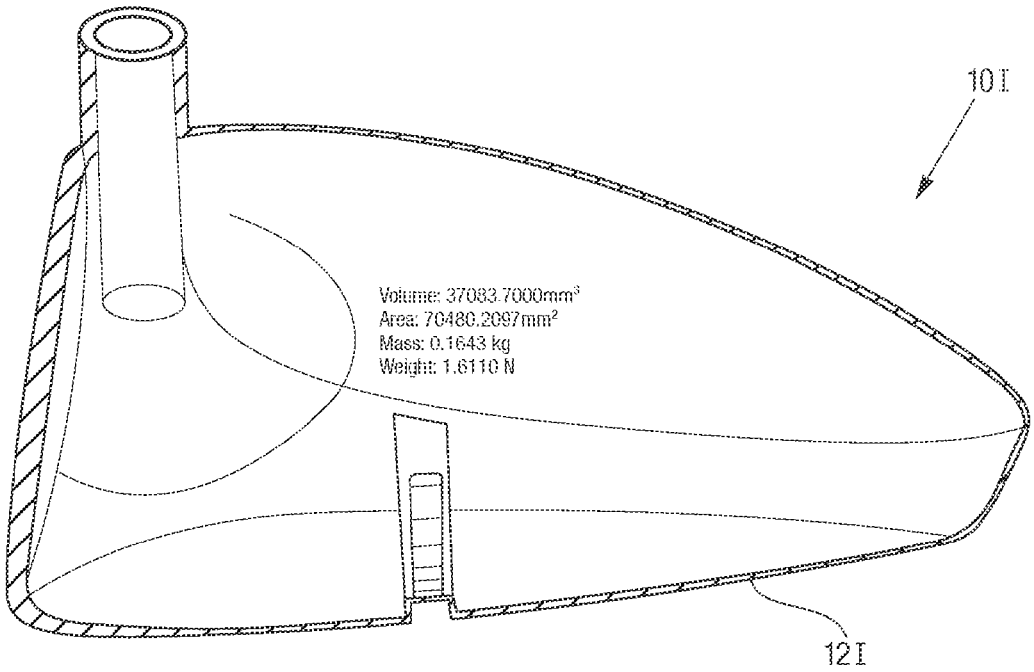
Figure 13:
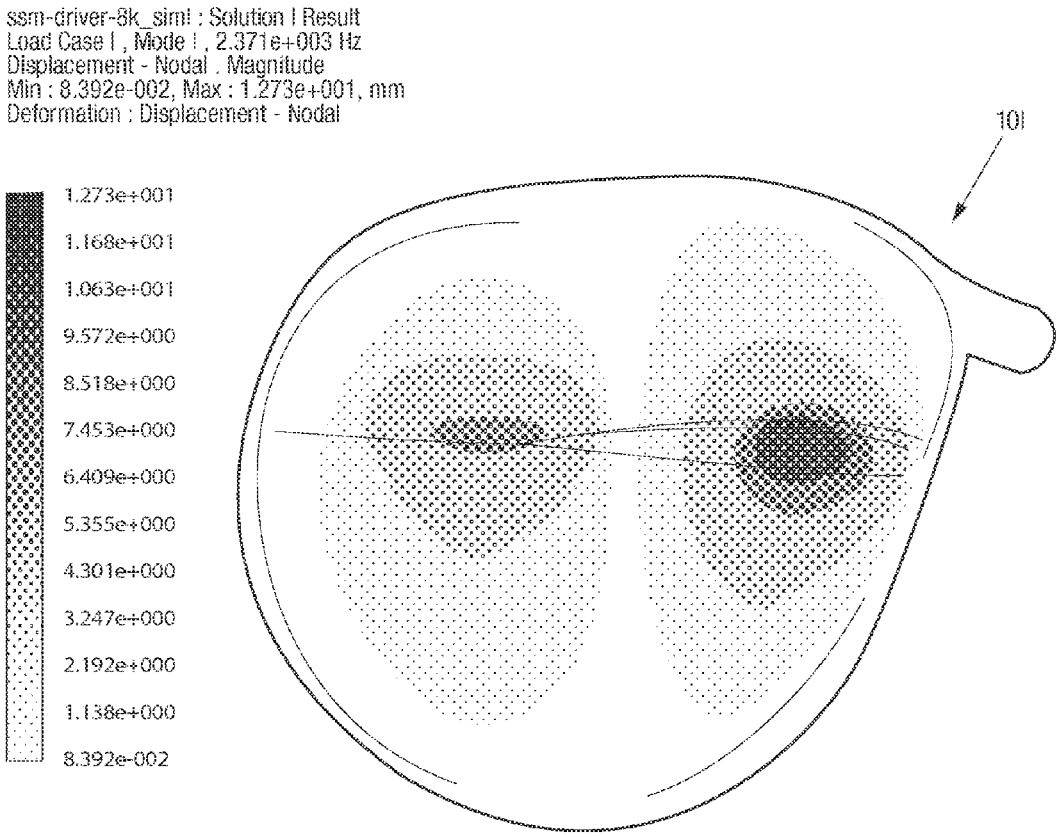
Figure 14:
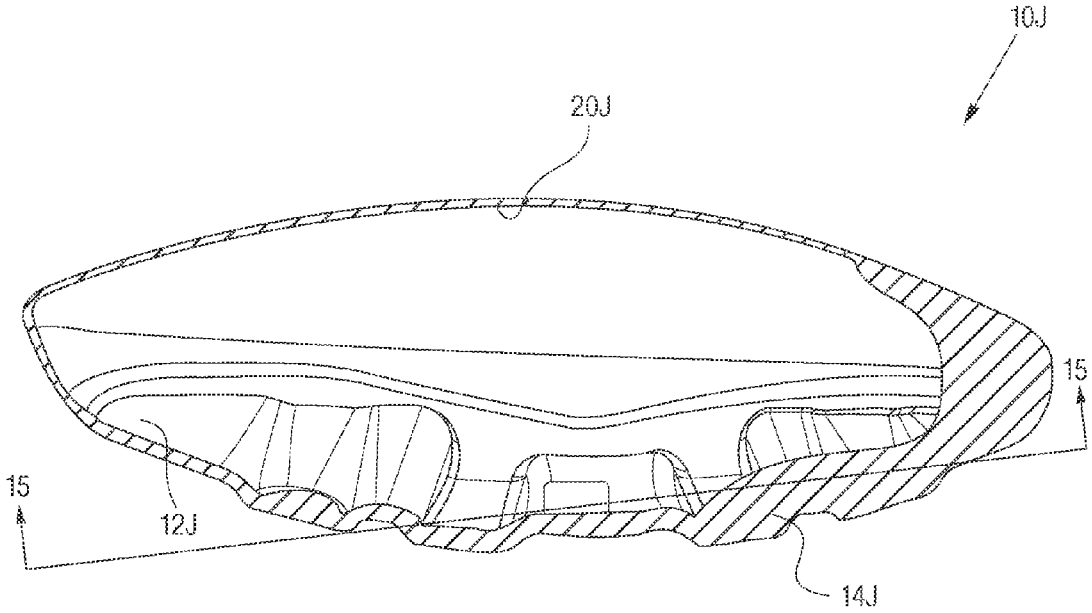
Figure 15:
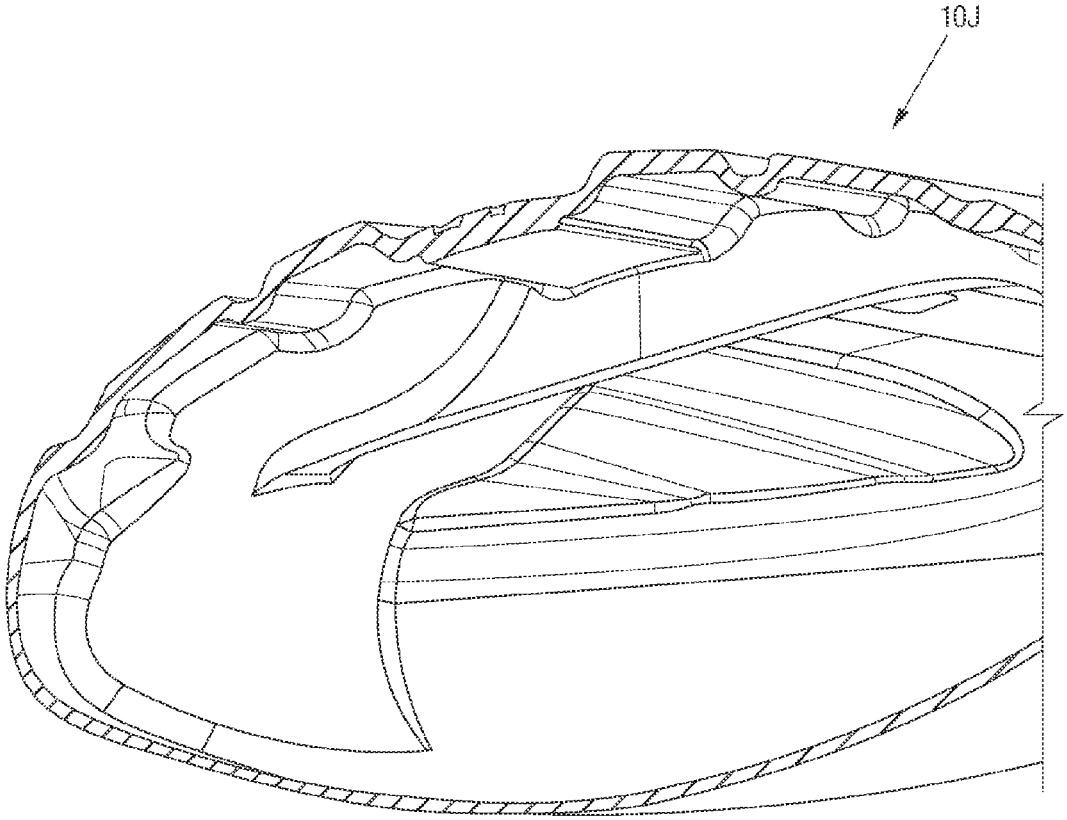
Figure 16:
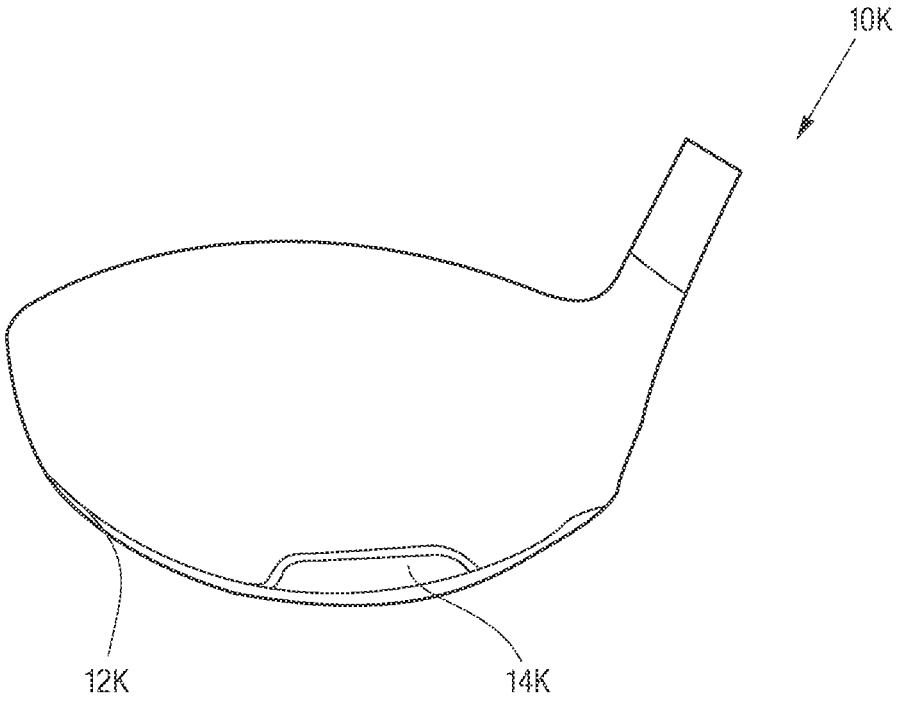
Figure 17:
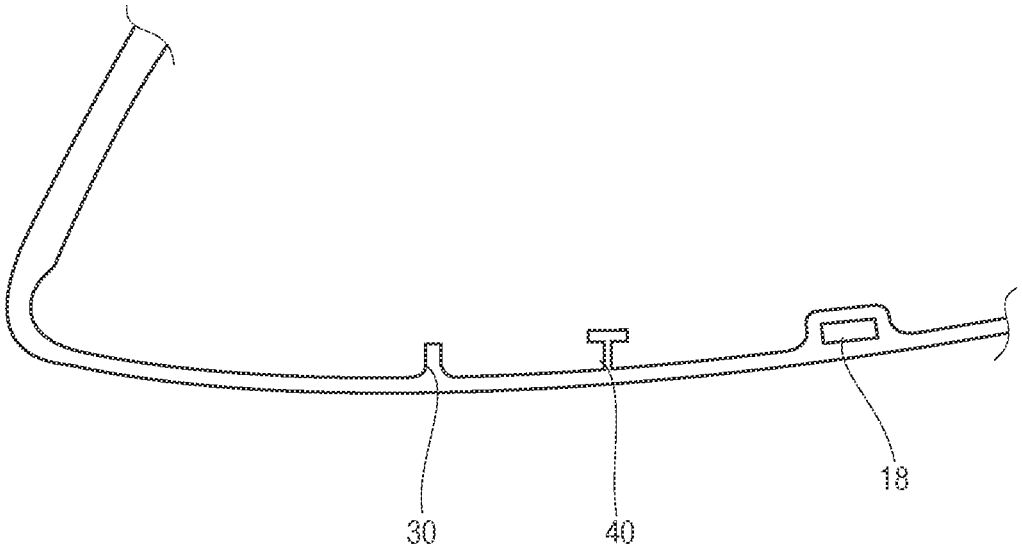

FIG. 8 is a cross-sectional view taken along line 8-8 of the golf club head of FIG. 6 having a stiffened sole with 0.75 mm in thickness and a box beam structure having a channel wall with 0.80 mm in thickness;

FIG. 9 is a simulation image of the golf club head of FIG. 1 having a stiffened sole with 0.75 mm in thickness and a box beam structure having a channel wall with 0.75 mm in thickness;

FIG. 10 is a cross-sectional view taken along line 10-10 of the golf club head of FIG. 6 having a stiffened sole with 0.75 mm in thickness and a box beam structure having a channel wall with 0.80 mm in thickness;

FIG. 11 is a simulation image of the sole portion of the golf club head of FIG. 10;

FIG. 12 is heel side view of the golf club head of FIG. 1 having a sole with a channel defined therein;

FIG. 13 is simulation image of the sole portion of the golf club head of FIG. 12;

FIG. 14 is a cross-sectional view of a golf club head having a thickened region wrapped from the sole portion, through the skirt portion, and into the crown portion;

FIG. 15 is a cross-sectional view taken along line 15-15 of the golf club head of FIG. 14;

FIG. 16 is a cross-sectional view of a golf club head having a thickened region on an internal surface of the golf club head; and FIG. 17 is a partial cross-sectional view of a golf club head having an example of an I shape rib, T shape rib, and a box beam structure.

DETAILED DESCRIPTION OF A PREFERRED EMBODIMENT

Referring now to the drawings, embodiments are illustrated and generally indicated at 10-10K in FIGS. 1-17. The present invention relates generally to golf clubs, and more particularly to a golf club head optimized for sound and improved structural stability. As will hereafter be more fully described, the embodiment of the golf club head 10 in accordance with the teachings herein is operable for providing a higher frequency sound.

More specifically, the golf club head has at least a sole portion which is sufficiently stiffened to provide a higher frequency sound, with minimal increase in the overall weight of the golf club head, which is aesthetically pleasing when the golf club head impacts the golf ball. The advantages of the present golf club head design include large, fairly flat, relatively thin and light sole portion that is stiffened in order to keep the weight of the golf club head low, improvement of the sound of the golf club head upon impact with a golf ball, and the use of minimal weight in the sole portion to provide more discretionary design weight for other uses.

It should be noted that the golf club head of the present invention may be included in a variety of golf clubs using known methods of attachment or connection. More specifically, the golf club head of the present invention may be configured for use with metal wood golf clubs, such as drivers or other fairway woods, which have an interior cavity. Typically, the volume of a golf club head of a metal wood or driver may range up to 470 cc, preferably 160 cc-470 cc. Of course, it is contemplated that golf clubs other than metal woods may be used made with a variety of materials and constructions since the means for stiffening the sole portion may be internal or external of the golf club head.

Each golf club head of a golf club produces a distinct sound and feel when it is impacts a golf ball. The sound and feel of the particular golf club head is produced by the vibration of the golf club head. Golf club head designs may be analyzed to determine vibration and to determine whether the sound and feel produced by a golf club head will be attractive to a golfer. In particular, the frequency values and displacement mode shapes are often determined for the golf club head. It is understood that lower frequencies usually detrimentally affect the sound and feel of a golf club head and higher frequencies usually positively affect the sound and feel of a golf club head.

The present invention provides the golf club head, such as used for a metal wood golf club or related clubs, optimized for sound. The golf club head has a body that defines an interior cavity. In one embodiment, the body includes a sole portion, a crown portion, a hosel, heel portion, toe portion, rear portion, and a front portion including a striking face. In the present invention, at least the sole portion is sufficiently stiffened to provide a higher frequency sound which in turn will improve the perception of the feeling and performance of the golf club head.

At least one or more internal means, external means, or combination thereof in whole or part, for stiffening the golf club head and, in particular, the sole portion may be provided. In addition to improving the sound of the golf club head, the means for stiffening the golf club head facilitates reinforcement of the golf club head. The internal means for stiffening the sole portion is substantially disposed within the interior cavity. The internal means for stiffening the sole portion engages at least an internal surface of the sole portion to provide a higher frequency sound. For example, the internal means for stiffening may include one or more of the following, in part or combination: one or more thickened region members, one or more rib members, or a box beam structure. Of course, these are examples and there are other methods and constructions contemplated for stiffening the sole portion.

Referring to FIGS. 1-11, the golf club head 10-10H is provided with a variety of methods for stiffening at least the sole portion to improve the sound of the golf club head which shall be described further below in the simulation study. Referring to FIG. 1, the golf club head 10 is illustrated to be used for purposes of the simulation images. The purpose of the study is to identify a golf club head that has at least a sole portion which is sufficiently stiffened to provide a higher frequency sound, with minimal increase in the overall weight of the golf club head, which is aesthetically pleasing when the golf club head impacts the golf ball.

During the study, the golf club head 10 included a stiffening means for stiffening or reinforcing the golf club head to optimize the sound of the golf club head by changing the frequency and displacement shape of the vibration modes. Generally, total vibration mode frequencies of less than about 3000 Hz are not desired. In particular, golf club head 10 includes stiffening means that both changes the vibration modes of the golf club head while minimizing the mass of the club head. The mass is manipulated at areas at or adjacent to one or more hot spots in the vibration mode. As used herein, hot spots are localized areas of the structure that exhibit increased displacement at the frequency of the vibration mode. For each vibration mode there is generally a primary hot spot that exhibits maximum displacement over the golf club head for that vibration mode. Some vibration modes exhibit secondary hot spots with local maximum displacement, but with a displacement magnitude that is less than that of the primary hot spot. In one embodiment, and based upon all of the studies above, the stiffened sole portion significantly increases the frequency range of the golf club head. In one embodiment, the stiffened sole portion increases the frequency range of the golf club head by at least 300 Hz to provide an overall frequency of greater than about 3000 Hz. For example, the stiffened sole portion of the external means for stiffening significantly increases the frequency range of the golf club head between approximately 100 Hz and 300 Hz or more, and more preferably between approximately 200 Hz and 300 Hz or more, and even more preferably greater than 300 Hz.

Figure 2:
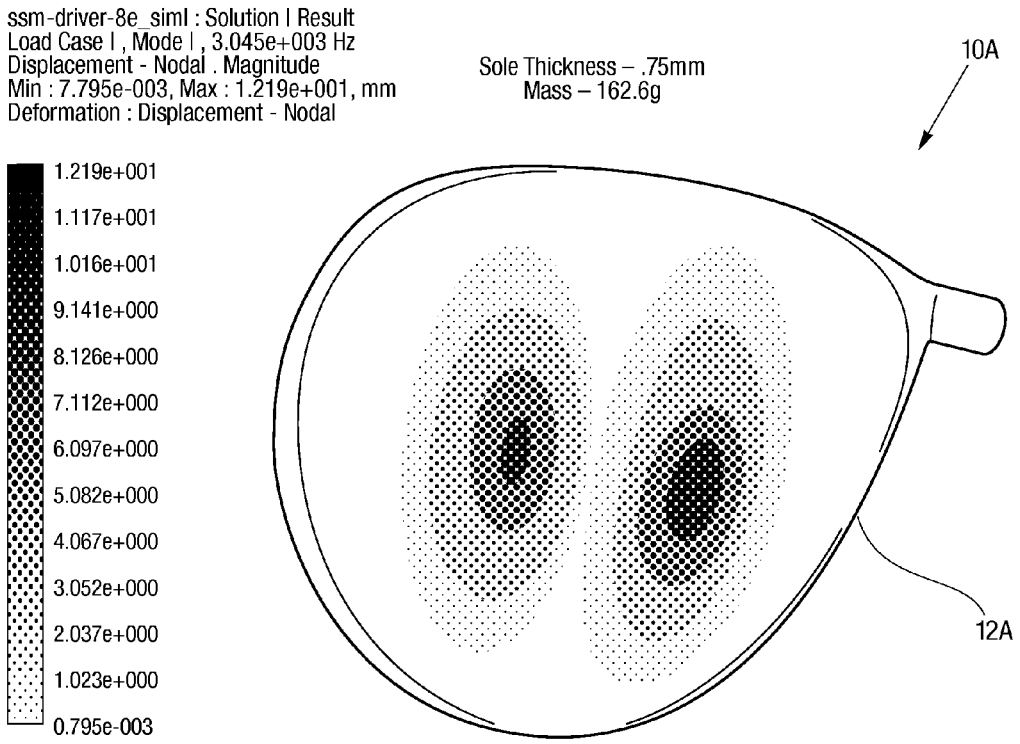
FIG. 2 is a simulation image of the sole portion of the golf club head of FIG. 1 having a stiffened sole with 0.75 mm in thickness.

Referring to FIG. 2, the golf club head 10A has a sole portion 12A which is sufficiently stiffened or reinforced using a thickened region or other stiffening means to increase the frequency of the golf club head 10A. The stiffened sole portion has 0.75 mm in thickness which is used as a baseline for purposes of this simulation study. With the sole portion having 0.75 mm in thickness, according to the study, the overall mass of this golf club head is 162.6 grams with a frequency of 3045 Hz.

Figure 3:
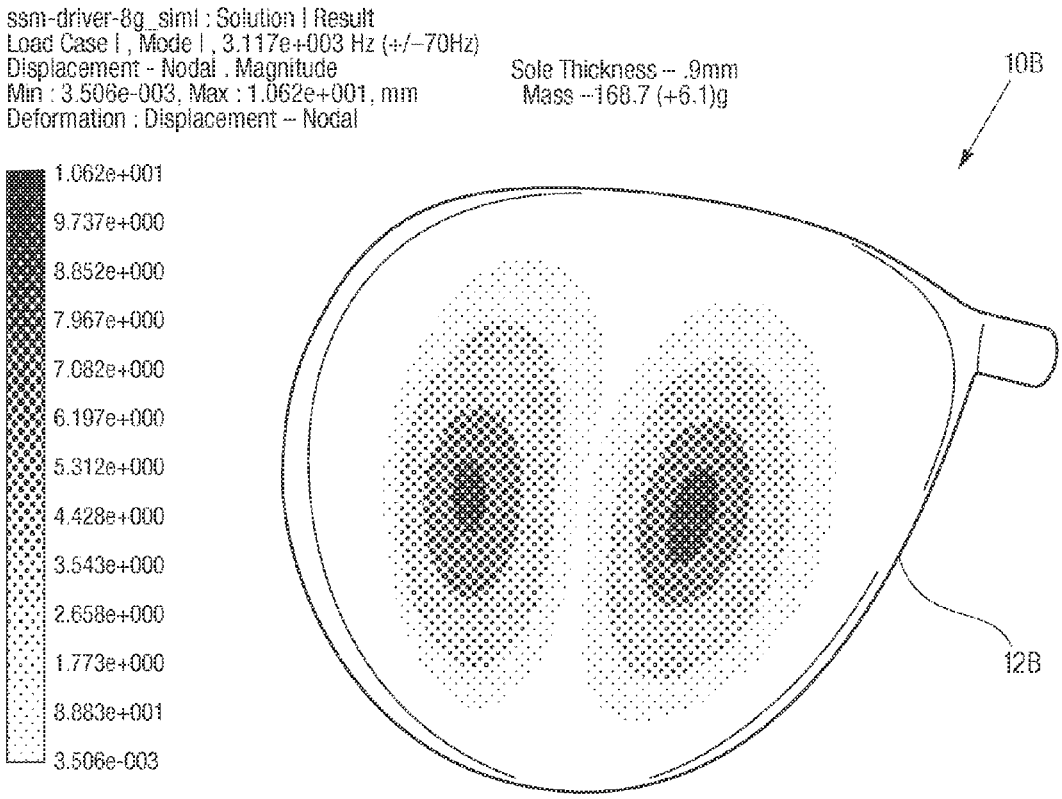
FIG. 3 is a simulation image of the sole portion of the golf club head of FIG. 1 having a stiffened sole with 0.9 mm in thickness.

Referring to FIG. 3, the golf club head 10B has a sole portion 12B which is sufficiently stiffened or reinforced using a thickened region or other stiffening means to increase the frequency of the golf club head 10B. The stiffened sole has 0.9 mm in thickness. With the sole portion having 0.9 mm in thickness, according to the study, the overall mass of this golf club head is 168.7 grams with a frequency of 3117 Hz. In comparison to the baseline of FIG. 2, the overall weight of the golf club head was increased by 6.1 grams with a corresponding increase of frequency of 72 Hz.

Figure 4:
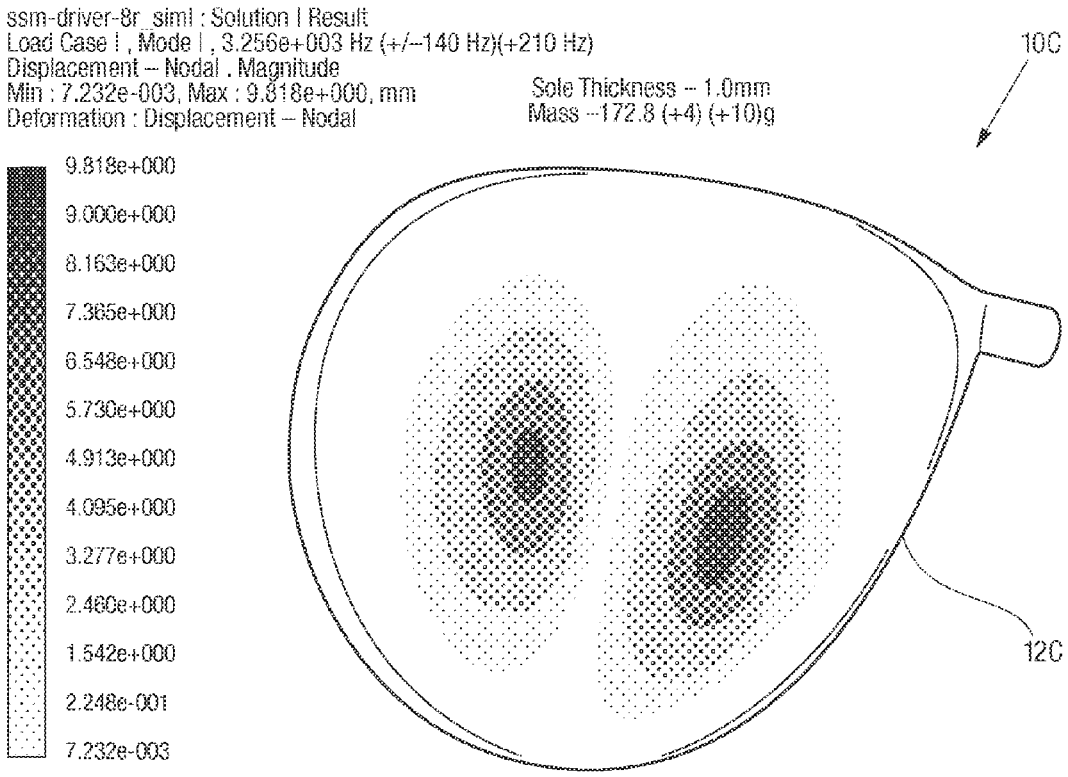
FIG. 4 is a simulation image of the sole portion of the golf club head of FIG. 1 having a stiffened sole with 1 mm in thickness.

Referring to FIG. 4, the golf club head 10C has a sole portion 12C which is sufficiently stiffened or reinforced using a thickened region or other stiffening means to increase the frequency of the golf club head 10C. The stiffened sole has 1 mm in thickness. With the sole portion having 1 mm in thickness, according to the study, the overall mass of this golf club head is 172.8 grams with a frequency of 3256 Hz. In comparison to the baseline of FIG. 2, the overall weight of the golf club head was increased by 10.2 grams with a corresponding increase of frequency of 211 Hz.

Figure 5:
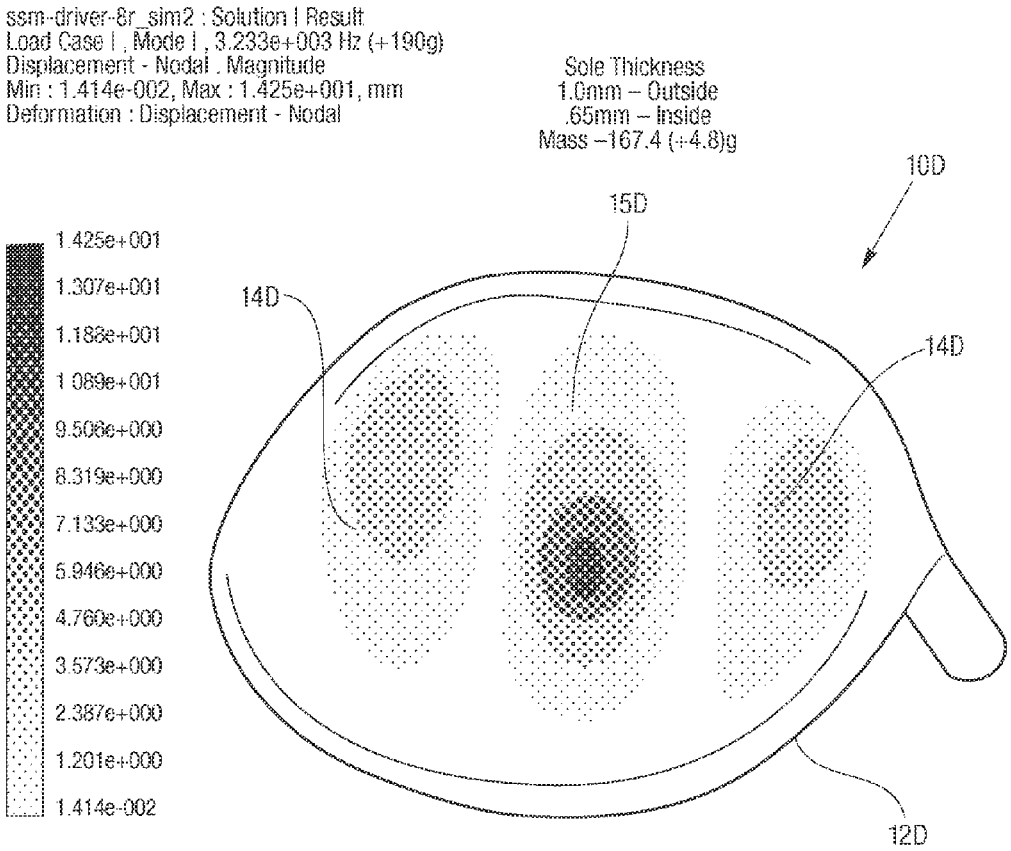
FIG. 5 is a simulation image of the sole portion of the golf club head of FIG. 1 having a first thickened region with 0.65 mm in thickness and a second thickened region with 1.0 mm in thickness.

Referring to FIGS. 5 and 6, the golf club head 10D has a sole portion 12D which is sufficiently stiffened or reinforced using a thickened region 14D, 15D, or other stiffening means to increase the frequency of the golf club head 10D. It should be noted that an alternative to a thickened region may be a weight pad or thickened region member to sufficiently stiffen or reinforce to increase the frequency of the golf club head. In this embodiment, there are two regions of the sole 14D, 15D having different thicknesses. The outer area 14D of the stiffened sole portion has 1 mm in thickness and the inside area 15D of the stiffened sole portion has 0.65 mm in thickness. With the sole portion 12D having two different thicknesses, according to the study, the overall mass of this golf club head 10D is 167.4 grams with a frequency of 3233 Hz. In comparison to the baseline of FIG. 2, the overall weight of the golf club head 10D was increased by 4.8 grams with a corresponding increase of frequency of 188 Hz. The embodiment of FIGS. 5 and 6 is an improvement, in terms of the increase of frequency to weight increase ratio, over the embodiments of FIGS. 3 and 4.

Figure 7:
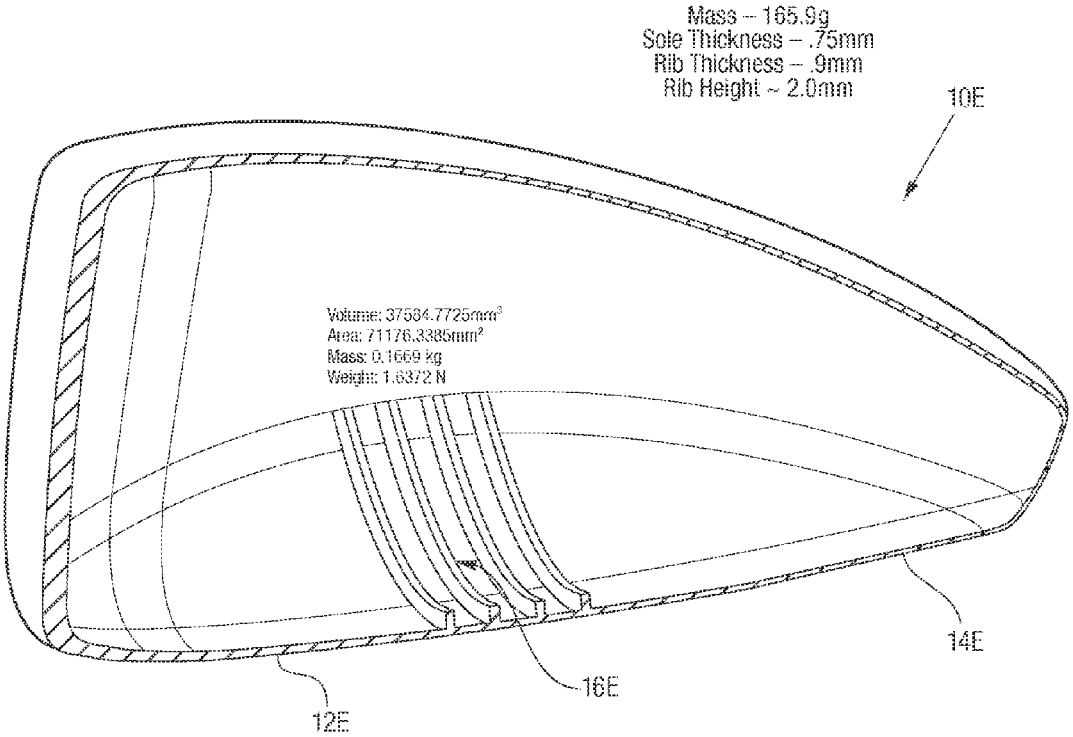
FIG. 7 is a cross-sectional view taken along line 7-7 of the golf club head of FIG. 6 having a stiffened sole with 0.75 mm in thickness and one or more ribs having a thickness of 0.9 mm and an approximate height of 2.0 mm.

Referring to FIG. 7, the golf club head 10E has a sole portion 12E which is sufficiently stiffened or reinforced using one or more ribs 16E, thickened regions 14E, or other stiffening means to increase the frequency of the golf club head 10E. The stiffened sole portion 12E has an integrally formed thickened region 14E with 0.75 mm in thickness and one or more ribs 16E each with a thickness of 0.9 mm and a rib height of approximately 2.0 mm It should be noted that the thickened region may also be in the form of a weight pad which is added for stiffening purposes by a variety of methods. In this configuration, according to the study, the overall mass of this golf club head 10E is 166.9 grams with a frequency of 3259 Hz. In comparison to the baseline of FIG. 2, the overall weight of the golf club head 10E was increased by 4.3 grams with a corresponding increase of frequency of 214 Hz. The embodiment of FIG. 7 is an improvement, in terms of the increase of frequency to weight increase ratio, over the embodiment of FIGS. 3-5.

To provide further detail, the thickened region of the golf club head has several embodiments including different locations, structures, and methods of formation. In one embodiment, the thickened region maybe attached, co-formed, integrally formed, coupled, secured, engaged, or connected to an internal or external surface of the golf club head. The golf club head may use one or more thickened regions having areas with differing degrees of thickness of material. The thickened region may have an external portion and/or an internal portion and be positioned anywhere on golf club head to provide stiffening, but preferably on at least the sole portion. The thickened region has various shapes and sizes projecting or extending from a portion of the golf club head to provide improved acoustical performance of the golf club head. One or more thickened regions may be used in the golf club head.

The thickened region may be integrally formed, in whole or in part, with the golf club head. In one embodiment, the thickened region may be entirely cast into the body of the golf club head. For example, the thickened region may have a large, relatively thin area to conform to the shape of the golf club head and is integrally formed with a surface of the body. The thickened region may perpendicularly project or extend from the surface of the body. Of course, it is contemplated that the thickened region may project or extend from the surface of the body less than or greater than a perpendicular angle.

In one embodiment, the thickened region may be integrally formed with the surface of the sole portion, through the skirt portion, and into the crown portion. For example, the thickened region is wrapped along an internal surface from the sole portion, through the skirt portion, and into the crown portion. In a further embodiment, the thickened region has a greater thickness in a first area of the thickened region where the skirt portion and sole portion blend into one another, a second area of the thickened region in a middle area of the sole portion less thick than the first area, and a third area of the thickened region in a middle area of the crown portion less thick than the first and second area. It should also be noted that the first area may also have a portion blending into the crown portion in one embodiment. Of course, the thickened region may be wrapped along an external surface, or partly of the internal and external surface, from the sole portion, through the skirt portion, and into the crown portion. Alternatively, the thickened region may include the first area, second area, and third area may be used alone or in combination with one another to provide a thickened region. By wrapping the thickened region from the sole portion, through the skirt portion, and into to the crown portion of the golf club head, this will effectively stiffen the boundary condition of both the sole portion and the crown portion thus enhancing and increasing the golf club head's frequency. It should be noted that the stiffening means, methods of manufacture, operation, and other features of the internal means for stiffening the golf club head may be adapted for use with the externals means for stiffening the golf club head and internal means for stiffening the golf club head.

In another embodiment, the thickened region is preformed, in whole or in part, and subsequently attached, coupled, secured, co-formed, secured, engaged or connected to a portion of the golf club head, preferably at least one or more of the sole portion, skirt portion, and the crown portion. This preformed thickened region may be one or more thickened region members or even a weight pad. In one embodiment, the thickened region member may be preformed and then attached to the body of the golf club head. In another embodiment, a portion of the preformed thickened region member may be welded or attached by other means known in the art, to an internal or external surface of one or more of the sole portion, skirt portion, and crown portion to provide the thickened region. For example, in one embodiment, the thickened region member is stamped into a three-dimensional form and then welded onto an internal surface of the golf club head. The thickened region member may be solid or monolithic, in whole or in part. Alternatively, the thickened region member may have a hollow internal cavity area when attached to body of the golf club head. It should be noted that the thickened region may be integrally formed, in whole or in part, and preformed, in whole or in part, in combination to provide the thickened region. In a further embodiment, the thickened region member is welded, co-formed, or cast to a surface of the golf club head. In another embodiment, the thickened region member is welded, co-formed, or cast to an internal or external surface of the sole portion, through the skirt portion, and into the crown portion.

The golf club head body of the above embodiments can be formed using casting or forging techniques, and the thickened region member can be secured to the body using other coupling techniques, such as welding, adhering, or fastening the box beam structure to the golf club head body. For example, in one embodiment, the thickened region member is formed separate from the body of the head and made of a one-piece configuration. The thickened region member may be a unitary structure and include subcomponents. The thickened region member can be coupled to or attached, rather than being formed as a one-piece configuration with, the body of the golf club head. In another embodiment, a channel is formed in or cut into at least a portion of respective portions of the golf club head body. The channel is sized and shaped to receive the thickened region member therein. The box thickened region member can be secured to and at least partially within the channel using conventional coupling techniques described above.

In another embodiment, a reinforced or stiffened sole portion is made separately from the golf club head. In one embodiment, the reinforced sole portion may have a thickened region or thickened region member. For example, a cast golf club head may have its sole portion cut out and removed, perhaps by laser cutting or other means in the art. Next, the new reinforced or stiffened sole portion is welded onto the cast head, or by other means in the art. This configuration results in a stiffer sole than that which could be cast in of equivalent weight. Of course, this concept of welding, attached, co-forming, or coupling the thickened region may be utilized for stamped driver construction whereby the thickened region may be welded to the inside of the stamped sole plate before the sole plate is welded into the rest of the golf club head.

Referring to FIG. 8, the golf club head 10F has a sole portion 12F which is sufficiently stiffened or reinforced using the box beam structure 18F, thickened region 14F, or other stiffening means to increase the frequency of the golf club head 10F. When the box beam structure 18F and thickened region 12F were added to the sole portion, the first frequency found in the sole of the golf club head 10F was 3434 Hz. The stiffened sole portion 12F has an integrally formed thickened region 14F with 0.75 mm in thickness and one or more channels of the box beam structure 18F each with one or more walls having a thickness of 0.8 mm. In this configuration, according to the study, the overall mass of this golf club head 10F is 166.5 grams with a first sole frequency of 3434 Hz. In comparison to the baseline of FIG. 2, the overall weight of the golf club head was increased by 3.9 grams with a corresponding increase of frequency of 389 Hz. The embodiment of FIG. 8 is an improvement, in terms of the increase of frequency to weight increase ratio, over all previous embodiments in the study which demonstrates the largest increase in the frequency and the smallest increase in overall golf club head weight. Based upon the study, the box beam structure across the sole is more effective than any other prior art means for reinforcing the sole. Of course, it should be noted that the box beam structure may be used in other portions of the golf club head.

Referring to FIG. 9, the golf club head 10G has a sole portion 12G which is sufficiently stiffened or reinforced using the box beam structure, thickened region, or other stiffening means to increase the frequency of the golf club head 10G. The first mode found in the golf club head was 3357 Hz, and that mode was in the crown. When the box beam structure and thickened region were added to the sole portion, the second mode found in the golf club head was 3438 Hz, and this mode was located in the sole. The stiffened sole portion has a thickened region with 0.75 mm in thickness and one or more channels of the box beam structure each with one or more walls having a thickness of 0.75 mm. In this configuration, according to the study, the overall mass of this golf club head is 166.3 grams with a frequency of 3438 Hz. In comparison to the embodiment of FIG. 8, the embodiment of FIG. 9 is a slight improvement, in terms of the increase of frequency to weight increase ratio.

Referring to FIGS. 10-11, the golf club head 10H has a sole portion 12H which is sufficiently stiffened or reinforced using the box beam structure 18H, integrally formed thickened region 14F, or other stiffening means to increase the frequency of the golf club head 10H. The stiffened sole portion 12H has a thickened region 14H with 0.75 mm in thickness and one or more channels of the box beam structure 18H each with one or more walls having a thickness of 0.80 mm. The weight of the box beam structure 18H overall is slightly lower due to the plate attached to the top end of the channel having defined apertures along its surface. In this configuration, according to the study, the overall mass of this golf club head 10H is 166.2 grams with a frequency of 3333 Hz. In comparison to the embodiment of FIG. 9, the embodiment of FIG. 10 is a slight decrease in performance, in terms of the increase of frequency to weight increase ratio.

To provide further detail, the box beam structure of the golf club head has several embodiments including different locations, structures, and methods of formation. The box beam structure may have an external portion and/or an internal portion and be positioned anywhere on golf club head to provide stiffening, but preferably on the sole portion. The box beam structure has various shapes and sizes projecting or extending from a portion of the golf club head to provide improved acoustical performance of the golf club head. The box beam structure may be co-formed, coupled, secured to, or attached to the golf club head. One or more box beam structures may be used in the golf club head. In one embodiment, the box beam structure includes one or more sides, such as four, a top, and a bottom. The sides are attached to the top and the bottom. It is contemplated that the sides, top, or bottom may be preformed and subsequently attached or integrally formed with a portion of the golf club head. In one embodiment, the box beam structure may be preformed and then attached to the body of the golf club head. In another embodiment, a preformed channel section may be welded or attached by other means known in the art, to an internal surface of the sole portion to provide a box beam structure. For example, in one embodiment, the box beam structure is stamped into a three-dimensional form and then welded onto an internal surface of the golf club head. The three-dimensional form may have a hollow internal cavity area when attached to body of the golf club head, preferably the sole portion. Of course, the three-dimensional form may be solid or monolithic, in whole or in part.

Further, the sides, top, and bottom of the box beam structure may be angled or perpendicular relative to a surface of the golf club head. For example, the box beam structure may have sides projecting from a surface of the golf club head which are angled at less than 90 degrees, such as approximately from 35 degree to 50 degree angles, to attach the sides to a curved surface of the golf club head, such as the sole portion. The top portion may be attached to the angled sides to provide the top portion along a horizontal plane. In one embodiment, the top portion is positioned along a substantially horizontal plane.

The sides, top, and bottom may individually, in various combinations, or collectively be preformed and then attached to each other or the golf club head in a variety of configurations and steps to provide the box-beam structure. In one embodiment, the sides and a top of the box-beam structure are preformed and then attached to an internal surface of the golf club head. In one embodiment, the internal surface or external surface of the golf club head serves as the bottom, top, or side of the box-beam structure. For example, the box-beam structure may have one or more sides, such as four, and a single top and a single bottom which is actually an internal surface of the golf club head. Thereby, the bottom defines a shape similar to a surface of the golf club head, such as a curved portion. The curved portion of the golf club head may be a sole portion, skirt portion, a crown portion, or any other curved area of the golf club head. Of course, the box beam structure may be attached to a non-curved portion, internal surface or external surface, of the golf club head as well. In yet another embodiment, the sides, a top, and bottom are preformed together into a unitary structure and then attached to the body of the golf club head.

The box beam structure, in one embodiment, may be integrally formed, in part or whole, within the body of the golf club head. In one embodiment, the box beam structure may be entirely cast into the body of the golf club head. For example, the box beam structure may have one or more sides, a top, and a bottom which is integrally formed with a surface of the body, such as the sole portion. The sides may perpendicularly project from the surface of the body, the top may be positioned along a substantially horizontal plane, and the bottom may be shaped in accordance with the surface of the body of the golf club head.

In another embodiment, the box beam structure may be partially integrally formed within the golf club head and another portion maybe preformed. For example, in one embodiment, a curved portion of the golf club head defines a cast channel. In one embodiment, the cast channel is defined on an external or internal surface of the curved portion of the golf club head, such as the sole. Alternatively, the cast channel is defined on an internal or external surface of a non-curved portion of the golf club head. Of course, the cast channel may be defined in a portion of both the internal surface and external surface of the golf club head. A flat plate or rod may then be attached over or cover the cast channel to provide the box beam structure. The flat plate or rod may be welded or adhesively attached over the cast channel or using a variety of other means.

In other embodiment, the golf club head body of the above embodiments can be formed using casting or forging techniques, and the box beam structure can be secured to the body using other coupling techniques, such as welding, adhering, or fastening the box beam structure to the golf club head body. For example, in one embodiment, the box beam structure is formed separate from the body of the head and made of a one-piece configuration. The box beam structure may be a unitary box-beam structure and include an elongate plate member. The box beam structure can be coupled to or attached, rather than being formed as a one-piece configuration with, the body of the golf club head. In another embodiment, a channel is formed in or cut into at least a portion of respective concave and convex portions of the golf club head body. The channel is sized and shaped to receive box beam structure therein. The box beam structure can be secured to and at least partially within the channel using conventional coupling techniques described above.

In one embodiment, the box beam structure is positioned along an internal or external surface of the body of the golf club head, preferably the sole portion. More specifically, the box beam structure may be positioned in a mid-sole portion area. The box beam structure may extend along from or between the heel portion to the toe portion. The box beam structure may extend or project from a portion the golf club head and into the interior of the cavity of the body. Alternatively, the box beam structure may extend or project from the golf club head and exterior to the body. Of course it is contemplated that the golf club head may extend into both an interior and exterior surface of the body.

In another embodiment, a reinforced or stiffened sole portion is made separately from the golf club head. In one embodiment, the reinforced sole portion may have a box beam structure. For example, a cast golf club head may have its sole portion cut out and removed, perhaps by laser cutting or other means in the art. Next, the new reinforced or stiffened sole portion is welded onto the cast head, or by other means in the art. This configuration results in a stiffer sole than that which could be cast in of equivalent weight. Of course, this concept of welding on the box beam structure may be utilized for stamped driver construction whereby the box beam structure may be welded to the inside of the stamped sole plate before the sole plate is welded into the rest of the golf club head.

Referring to FIGS. 12-13, the golf club head 10I has a sole portion 12I which defines just a channel. The sole portion 12I defines a channel extending from heel portion to toe portion of the golf club head. In this configuration, according to the study, the overall mass of this golf club head is 164.3 grams with a frequency of 2371 Hz. In comparison to the baseline of FIG. 2, the embodiment of FIGS. 12-13 had a significant decrease in performance, in terms of the increase of frequency to weight increase ratio. In other words, it would be preferable to do the baseline or possibly nothing at all than to both decrease the frequency and increase the weight as disclosed with this golf club head 10I.

Referring to FIG. 16, the golf club head 10K may have a thickened region 14K, which in this embodiment is a composite panel head stiffener, with connected or attached to the sole portion 12K. The composite panel head stiffener includes a stamped three dimensional preformed structure. Alternatively, the composite head stiffener may be a flat plate or rod. The composite head stiffener may be made of one or more materials including titanium and other metals and materials. In one embodiment, the composite head stiffener is welded, attached, or otherwise connected to an internal surface of the sole portion. Also, the composite head stiffener may be welded, attached, or otherwise connected to an external surface of the sole portion. For example, the composite head stiffener may be threadably attached to the sole portion. It is also contemplated that the composite head stiffener may be preformed and then welded or cast into the sole portion.

Referring back to FIG. 5, the sole portion 12D may include a first thickened region 14D defining a first region thickness and a second thickened region 15D defining a second region thickness. In one embodiment, one or more first thickened regions are located on a central area of the sole portion and the one or more second thickened regions are located proximally on either side of the central area. Also, the thickened region may have a range of thickness, in one embodiment, less than or equal to 1 mm. Of course, one more thickened region areas may be used having a range of thickened region area thickness to provide a higher frequency with a minimal increase in the overall weight of the golf club head. Furthermore, in another embodiment, the range of thickness of the internal means for stiffening the sole portion is greater than the range of thickness of the internal means for stiffening the crown portion.

Referring to FIG. 17, FIG. 17 shows examples of previously discussed means for stiffening. In one embodiment, an internal surface of a separate sole portion is first stiffened with one or more ribs and subsequently welded to the golf club head. In one embodiment, the ribs or other means for stiffening are positioned along an internal surface of the sole portion or other portions of the golf club head from a head portion to toe portion. As shown in FIG. 17, the small cast-in ribs, such as an "I" shape 30 or "T" shape 40, on an internal surface of the sole portion may provide some stiffening. Of course, other shapes and configurations of the small cast-in ribs may be used.

In another embodiment, the reinforced or stiffened sole portion is made separately from a cast golf club head. The stiffened sole portion may have internal ribs added for the separate sole portion apart from the golf club head which is more efficient than ribs that are added when casting the golf club head. In one embodiment, the cast golf club head has its cast sole portion cut out and removed, perhaps by laser cutting or other known methods. The cut out sole portion is stiffened or reinforced with a means for stiffening as described herein, such as ribs, and then the sole portion is reattached or connected to the cast golf club head. In one embodiment, the sole portion is welded to the cast golf club head. By stiffening or reinforcing the sole portion separate from the golf club head before connection, the sole portion is stiffer than that which could be cast in equivalent weight.

It should be noted that the stiffening or reinforcement of the separate sole portion before attachment or connection to the golf club head may be used with regards to other methods of manufacture. For example, the reinforcement or stiffening of the sole portion separate from the golf club head may be also used in a four piece, or any number of pieces, stamped golf club construction. The means for stiffening may be welded to the internal surface of the stamped sole portion before the sole portion is welded to the golf club head. Of course, this is merely an example and other methods of manufacture may be used in the construction of the golf club head.

The internal means and external means for stiffening of the sole portion may be configured with the golf club head using a variety of methods of manufacture, but not limited to, welding, casting, press-forming, mechanical joining, press-fitting, mechanical fasteners, forming, joining, molding, thermal-diffusion pressing, explosive bonding, forging, brazing, stamping, diffusion, and adhesive bonding or any of various combinations of these methods.

In still another embodiment, a preformed channel having a plate member is welded to an internal surface of the sole portion. Referring to FIG. 17, in a further embodiment, the channel is cast into an internal surface of the sole portion and a plate is welded over the top of the channel to provide a box beam structure 18. In another embodiment, the box beam structure 18 is separately formed and then attached or connected to the sole portion. The box beam structure 18 may be more easily cast, connected or otherwise attached to the sole portion, and lighter in weight, given its construction as compared to other cast-in ribs. Of course, other configurations and shapes of stiffening beam structures may be used across the sole portion to improve the sound.

In one embodiment, the channel is cast into the sole portion of a driver, and then a preformed plate is welded on over an open top end of the channel. This forms an integral box beam structure or reinforcement running across the sole portion internally. After welding and polishing of the golf club head, this integral box beam structure could be completely or substantially hidden from an external view of the golf club head. Alternatively, the box beam structure may be configured as part of the external surface of the sole portion of the golf club head which can be as part of the ornamental aspects of the golf club head. In another embodiment, the channel is preformed and then welded onto an internal surface of the sole portion of the golf club head.

In yet another embodiment, the thickened region is integrally formed along an internal surface of the sole portion and the crown portion. Alternatively, referring to FIGS. 14-15, the golf club head 10J has a thickened region 14J wrapped along a surface of the sole portion 12J, through the skirt portion, and into the crown portion 20J. By wrapping the thickened region 14J from the sole portion 12J to the crown portion 20J of the golf club head 10J, this will effectively stiffen the boundary condition of both the sole portion 12J, skirt portion, and the crown portion 20J thus enhancing and increasing the golf club head's frequency.

In another embodiment, at least one or more external means for stiffening the sole portion may be provided. The external means for stiffening the sole portion is substantially disposed on an external surface of the body. The external means for stiffening the sole portion engages at least an external surface of the sole portion to provide a higher frequency sound. For example, the external means for stiffening may include one or more of the following: one or more thickened region members, one or more rib members, or a channel having a plate member to provide a box beam structure. In one embodiment, the stiffened sole portion of the external means for stiffening increases the frequency range of the golf club head. In one embodiment, the stiffened sole portion of the external means increases the frequency range of the golf club head by at least 300 Hz to provide an overall frequency of greater than about 3000 Hz. For example, the stiffened sole portion of the external means for stiffening significantly increases the frequency range of the golf club head between approximately 100 Hz and 300 Hz or more, and more preferably between approximately 200 Hz and 300 Hz or more, and even more preferably greater than 300 Hz.

In one embodiment, the thickened region member is welded to an external surface of the sole portion. The sole portion may include a first thickened region area defining a first thickened region area thickness and a second thickened region area defining a second thickened region area thickness. Also, the thickened region member may have a range of thickness, in one embodiment, less than or equal to 1 mm. Of course, one more thickened region areas may be used having a range of thickened region area thickness to provide a higher frequency with a minimal increase in the overall weight of the golf club head. Furthermore, in another embodiment, the thickness of the external means for stiffening the sole portion is greater than thickness of the internal means for stiffening the crown portion.

In another embodiment, an external surface of a separate sole portion is first stiffened with the one or more ribs and subsequently welded to the golf club head. In a further embodiment, the channel is cast into an external surface of the sole portion and a plate is welded over the top of the channel to provide a box beam structure. In still another embodiment, a preformed channel having a plate member is welded to an external surface of the sole portion. In yet another embodiment, the thickened region is formed along an external surface of the sole portion and the crown portion.

Alternatively, the thickened region is wrapped along an external surface from the sole portion, through the skirt portion, and into the crown portion. By wrapping the thickened region from the sole portion, through the skirt portion, and into the crown portion of the golf club head, this will effectively stiffen the boundary condition of both the sole portion, skirt portion, and the crown portion thus enhancing and increasing the golf club head's frequency. It should be noted that the stiffening means, methods of manufacture, operation, and other features of the internal means for stiffening the golf club head may be adapted for use with the externals means for stiffening the golf club head and visa versa.

The internal and external means for stiffening at least the sole portion provides a higher frequency sound with a minimal increase in the overall weight of the golf club head. In one embodiment, the stiffened sole portion increases the weight of the golf club head by less than about 10 grams with the overall weight of the golf club head being less than 200 grams. In operation, the golf club head with at least the stiffened sole portion impacts the golf ball to provide an aesthetically pleasing sound.

While there is shown and described herein certain specific structure of the exemplary embodiments, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A golf club head, comprising:

a body including at least one of a crown portion or a skirt portion, and a sole portion, or a sole portion, the body defines an interior cavity and having an overall frequency in response to impacting a golf ball;

a box beam structure defining a hollow internal area for stiffening at least the sole portion is disposed completely within the interior cavity, the box beam structure engages at least an internal surface of the sole portion and is configured to provide a higher frequency sound, the box beam structure for stiffening the sole portion provides a higher frequency with minimal increase in the overall weight of the golf club head, the box beam structure for stiffening at least the sole portion increases the overall weight of the club by less than about 10 grams wherein the box beam structure has sides projecting from the sole portion angled between 35 to 50 degree angles;

whereby the golf club head provides an aesthetically pleasing sound upon impact with a golf ball.

2. The golf club head of claim 1, wherein a channel is cast into an internal surface of the sole portion and a plate is welded over the top of the channel to provide the box beam structure.

3. The golf club head of Claim 1, wherein the box beam structure is welded to an internal surface of the sole portion.

4. The golf club head of claim 1 wherein the box beam structure has one or more channel walls.

5. The golf club head of claim 1, wherein the box beam structure is stamped into a three-dimensional form having the hollow internal area.

6. The golf club head of claim 1, wherein the box beam structure is configured to be completely hidden from an external view of the golf club head.

7. The golf club head of claim 1, wherein the sole portion may include a first thickened region defining a first region thickness and a second thickened region defining a second region thickness.

8. The golf club head of claim 7, wherein the first thickened regions is located on a central area of the sole portion and the second thickened regions is located proximally on either side of the central area.

* * * * *